US010471449B2

(12) United States Patent
Gehrung

(10) Patent No.: US 10,471,449 B2
(45) Date of Patent: Nov. 12, 2019

(54) AIR CAP ARRANGEMENT AND SPRAY GUN

(71) Applicant: SATA GmbH & Co. KG, Kornwestheim (DE)

(72) Inventor: Ralf Gehrung, Backnang (DE)

(73) Assignee: SATA GMBH & CO. KG, Kornwestheim (DE)

( * ) Notice: Subject to any disclaimer, the term of this patent is extended or adjusted under 35 U.S.C. 154(b) by 0 days.

(21) Appl. No.: 15/679,482

(22) Filed: Aug. 17, 2017

(65) Prior Publication Data

US 2018/0050356 A1 Feb. 22, 2018

(30) Foreign Application Priority Data

Aug. 19, 2016 (CN) ..... 2016 2 0911120 U

(51) Int. Cl.

| | |
|---|---|
| ***B05B 15/65*** | (2018.01) |
| ***B05B 7/08*** | (2006.01) |
| ***B05B 1/30*** | (2006.01) |
| *B05B 7/06* | (2006.01) |
| *B05B 7/12* | (2006.01) |
| *B05B 7/24* | (2006.01) |

(52) U.S. Cl.

CPC ..... *B05B 7/083* (2013.01); *B05B 1/3046* (2013.01); *B05B 7/0815* (2013.01); *B05B 15/65* (2018.02); *B05B 7/068* (2013.01); *B05B 7/1245* (2013.01); *B05B 7/2478* (2013.01)

(58) Field of Classification Search

CPC ..... B05B 7/083; B05B 15/65; B05B 1/3046; B05B 7/0815; B05B 7/068; B05B 7/1245; B05B 7/2478

USPC ..... 239/290

See application file for complete search history.

(56) References Cited

U.S. PATENT DOCUMENTS

| | | | |
|---|---|---|---|
| 40,433 | A | 10/1863 | Sees |
| 327,260 | A | 9/1885 | Hart |
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |

(Continued)

FOREIGN PATENT DOCUMENTS

| | | |
|---|---|---|
| AT | 153883 | 6/1997 |
| AT | 163577 | 3/1998 |

(Continued)

OTHER PUBLICATIONS

Office Action dated Aug. 7, 2015 for U.S. Appl. No. 13/991,285.

(Continued)

*Primary Examiner* — Chee-Chong Lee

(74) *Attorney, Agent, or Firm* — Paul D. Bianco; Stephen Bongini; Fleit Intellectual Property Law

(57) ABSTRACT

An air cap arrangement and a spray gun. The air cap arrangement comprises an air cap, an air cap ring and a retaining ring. The air cap ring comprises a groove configured to extend on the circumferential inner surface of the air cap ring. The air cap also comprises a groove configured to extend on the circumferential outer surface of the air cap, and the retaining ring is arranged in the groove of the air cap ring and the groove of the air cap to limit the axial movement of the air cap within the air cap ring.

18 Claims, 11 Drawing Sheets

(56) References Cited

U.S. PATENT DOCUMENTS

| | | | | |
|---|---|---|---|---|
| 581,107 | A | | 4/1897 | Emery |
| 644,803 | A | | 3/1900 | Justi |
| 672,012 | A | | 4/1901 | Ruper |
| 574,880 | A | | 5/1901 | Schmidt et al. |
| 1,662,496 | A | | 3/1928 | Forsgard |
| 1,703,383 | A | | 2/1929 | Birkenmaier |
| 1,703,384 | A | | 2/1929 | Birkenmaier |
| 1,711,221 | A | | 4/1929 | Blakeslee |
| 1,751,787 | A | | 3/1930 | Binks |
| 1,889,201 | A | | 11/1932 | Holveck |
| 2,004,303 | A | | 6/1935 | Wahlin |
| 2,008,381 | A | | 7/1935 | Beeg |
| 2,049,700 | A | | 8/1936 | Gustafsson |
| 2,051,210 | A | | 8/1936 | Gustafsson |
| 2,070,696 | A | | 2/1937 | Tracy |
| 2,116,036 | A | | 5/1938 | Money |
| 2,125,445 | A | | 8/1938 | Holveck |
| 2,198,441 | A | | 4/1940 | Mollart |
| 2,204,599 | A | | 6/1940 | Jenkins |
| 2,269,057 | A | | 1/1942 | Jenkins |
| D133,223 | S | | 7/1942 | Tammen |
| 2,356,865 | A | | 8/1944 | Mason |
| 2,416,856 | A | | 3/1947 | Thomsen |
| 2,416,923 | A | | 3/1947 | Jenkins |
| 2,557,593 | A | | 6/1951 | Bjorkman |
| 2,557,606 | A | | 6/1951 | Liedberg |
| 2,559,091 | A | | 7/1951 | Reasenberg |
| 2,609,961 | A | | 9/1952 | Sapien |
| 2,612,899 | A | | 10/1952 | Webb |
| 2,646,314 | A | | 7/1953 | Peeps |
| 2,721,004 | A | | 10/1955 | Schultz |
| 2,743,963 | A | | 5/1956 | Peeps |
| 2,844,267 | A | | 7/1958 | Petriccione |
| 2,886,252 | A | | 5/1959 | Ehrensperger |
| 3,090,530 | A | | 5/1963 | Peeps |
| D196,477 | S | | 10/1963 | Kelly |
| 3,159,472 | A | | 12/1964 | Revell |
| D200,594 | S | | 3/1965 | Sass |
| 3,240,398 | A | | 3/1966 | Dalton, Jr. |
| D204,306 | S | | 4/1966 | Hamm |
| D205,760 | S | | 9/1966 | Hocutt et al. |
| D208,903 | S | | 10/1967 | Zadron et al. |
| 3,344,992 | A | | 10/1967 | Norris |
| 3,381,845 | A | | 5/1968 | MacDonald |
| 3,417,650 | A | | 12/1968 | Varrin |
| 3,420,106 | A | | 1/1969 | Keller et al. |
| 3,435,683 | A | | 4/1969 | Keller et al. |
| 3,482,781 | A | | 12/1969 | Sharpe |
| D217,928 | S | | 6/1970 | Felske |
| 3,524,589 | A | | 8/1970 | Pelton, Jr. |
| 3,527,372 | A | | 9/1970 | Manning |
| 3,583,632 | A | | 6/1971 | Schaffer |
| 3,622,078 | A | | 11/1971 | Gronert |
| 3,645,562 | A | | 2/1972 | Fandetti et al. |
| 3,656,493 | A | | 4/1972 | Black et al. |
| 3,714,967 | A | | 2/1973 | Zupan et al. |
| 3,746,253 | A | | 7/1973 | Walberg |
| 3,747,850 | A | | 7/1973 | Hastings et al. |
| 3,771,539 | A | | 11/1973 | De Santis |
| 3,840,143 | A | | 10/1974 | Davis et al. |
| 3,848,807 | A | | 11/1974 | Partida |
| 3,857,511 | A | | 12/1974 | Govindan |
| 3,870,223 | A | | 3/1975 | Wyant |
| 3,873,023 | A | | 3/1975 | Moss et al. |
| 3,938,739 | A | | 2/1976 | Bertilsson |
| 4,000,915 | A | | 1/1977 | Strom |
| D245,048 | S | | 7/1977 | Pool |
| D252,097 | S | | 6/1979 | Probst et al. |
| 4,160,525 | A | | 7/1979 | Wagner |
| 4,171,091 | A | | 10/1979 | van Hardeveld et al. |
| 4,210,263 | A | | 7/1980 | Bos |
| 4,273,293 | A | | 6/1981 | Hastings |
| 4,278,276 | A | * | 7/1981 | Ekman ..... F16L 37/088 285/321 |
| 4,411,387 | A | | 10/1983 | Stern et al. |
| 4,478,370 | A | | 10/1984 | Hastings |
| D276,472 | S | | 11/1984 | Harrison |
| D278,543 | S | | 4/1985 | Gintz |
| 4,545,536 | A | | 10/1985 | Avidon |
| 4,562,965 | A | | 1/1986 | Ihmels et al. |
| 4,580,035 | A | | 4/1986 | Luscher |
| 4,585,168 | A | | 4/1986 | Even et al. |
| 4,614,300 | A | | 9/1986 | Falcoff |
| 4,643,330 | A | | 2/1987 | Kennedy |
| 4,653,661 | A | | 3/1987 | Buchner et al. |
| 4,667,878 | A | | 5/1987 | Behr |
| 4,713,257 | A | | 12/1987 | Luttermoeller |
| D293,950 | S | | 1/1988 | Ogden et al. |
| 4,730,753 | A | | 3/1988 | Grime |
| 4,767,057 | A | | 8/1988 | Degli et al. |
| D298,372 | S | | 11/1988 | Taylor, Jr. |
| 4,784,184 | A | | 11/1988 | Gates |
| 4,806,736 | A | | 2/1989 | Schirico |
| 4,826,539 | A | | 5/1989 | Harpold |
| 4,832,232 | A | | 5/1989 | Broccoli |
| 4,863,781 | A | | 9/1989 | Kronzer |
| 4,877,144 | A | | 10/1989 | Thanisch |
| D305,057 | S | | 12/1989 | Morgan |
| 4,887,747 | A | | 12/1989 | Ostrowsky et al. |
| 4,901,761 | A | | 2/1990 | Taylor |
| 4,906,151 | A | | 3/1990 | Kubis |
| 4,917,300 | A | | 4/1990 | Gloviak et al. |
| 4,946,075 | A | | 8/1990 | Lundback |
| 4,964,361 | A | | 10/1990 | Aebersold |
| 4,967,600 | A | | 11/1990 | Keller |
| 4,969,603 | A | | 11/1990 | Norman |
| 4,973,184 | A | | 11/1990 | La Salle |
| D314,421 | S | | 2/1991 | Tajima et al. |
| D314,588 | S | | 2/1991 | Denham |
| 4,989,787 | A | | 2/1991 | Nikkel et al. |
| 5,020,700 | A | | 6/1991 | Krzywdziak et al. |
| D318,877 | S | | 8/1991 | Miranda et al. |
| 5,042,840 | A | | 8/1991 | Rieple et al. |
| D321,597 | S | | 11/1991 | Cerny |
| 5,064,119 | A | | 11/1991 | Mellette |
| 5,071,074 | A | | 12/1991 | Lind |
| 5,074,334 | A | | 12/1991 | Onodera |
| 5,078,323 | A | | 1/1992 | Frank |
| 5,080,285 | A | | 1/1992 | Toth |
| 5,088,648 | A | | 2/1992 | Schmon |
| 5,090,623 | A | | 2/1992 | Burns et al. |
| 5,102,045 | A | | 4/1992 | Diana |
| 5,119,992 | A | | 6/1992 | Grime |
| 5,125,391 | A | | 6/1992 | Srivastava et al. |
| 5,135,124 | A | | 8/1992 | Wobser |
| 5,143,102 | A | | 9/1992 | Blaul |
| 5,165,605 | A | | 11/1992 | Morita et al. |
| 5,170,941 | A | | 12/1992 | Morita et al. |
| 5,190,219 | A | | 3/1993 | Copp, Jr. |
| 5,191,797 | A | | 3/1993 | Smith |
| 5,228,488 | A | | 7/1993 | Fletcher |
| 5,232,299 | A | | 8/1993 | Hiss |
| 5,236,128 | A | | 8/1993 | Morita et al. |
| 5,249,746 | A | | 10/1993 | Kaneko et al. |
| D341,186 | S | | 11/1993 | Albers |
| 5,289,974 | A | | 3/1994 | Grime et al. |
| 5,322,221 | A | | 6/1994 | Anderson |
| 5,325,473 | A | | 6/1994 | Monroe et al. |
| 5,332,156 | A | | 7/1994 | Wheeler |
| 5,333,506 | A | | 8/1994 | Smith et al. |
| 5,333,908 | A | | 8/1994 | Dorney et al. |
| 5,344,078 | A | | 9/1994 | Fritz et al. |
| 5,367,148 | A | | 11/1994 | Storch et al. |
| D353,836 | S | | 12/1994 | Carvelli et al. |
| 5,381,962 | A | | 1/1995 | Teague |
| 5,435,491 | A | | 7/1995 | Sakuma |
| 5,443,642 | A | | 8/1995 | Bienduga |
| 5,456,414 | A | | 10/1995 | Burns et al. |
| D365,952 | S | | 1/1996 | Gagnon et al. |
| 5,503,439 | A | | 4/1996 | LaJeunesse et al. |
| 5,529,245 | A | | 6/1996 | Brown |
| 5,533,674 | A | | 7/1996 | Feyrer et al. |
| 5,540,385 | A | | 7/1996 | Garlick |
| 5,540,386 | A | | 7/1996 | Roman |

(56) References Cited

U.S. PATENT DOCUMENTS

D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
5,725,161 A * 3/1998 Hartle ..... B05B 5/053 118/629
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 5/2001 Vacher et al.
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Blette et al.
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin

(56) References Cited

U.S. PATENT DOCUMENTS

| | | | |
|---|---|---|---|
| 7,533,678 | B2 | 5/2009 | Rosa |
| 7,540,434 | B2 | 6/2009 | Gohring et al. |
| 7,542,032 | B2 | 6/2009 | Kruse |
| 7,568,638 | B2 | 8/2009 | Gehrung |
| D604,394 | S | 11/2009 | Wang |
| 7,614,571 | B2 | 11/2009 | Camilleri et al. |
| D607,086 | S | 12/2009 | Kosaka |
| 7,624,869 | B2 | 12/2009 | Primer |
| D607,972 | S | 1/2010 | Wang |
| D608,858 | S | 1/2010 | Baltz et al. |
| D614,731 | S | 4/2010 | Wang |
| 7,694,893 | B2 | 4/2010 | Zittel et al. |
| 7,694,896 | B2 | 4/2010 | Turnbull et al. |
| D615,586 | S | 5/2010 | Kudimi |
| D616,022 | S | 5/2010 | Kudimi |
| D616,527 | S | 5/2010 | Anderson et al. |
| 7,765,876 | B1 | 8/2010 | Chen |
| D624,668 | S | 9/2010 | Noppe |
| 7,810,744 | B2 | 10/2010 | Schmon et al. |
| 7,819,341 | B2 | 10/2010 | Schmon et al. |
| D627,039 | S | 11/2010 | Yu |
| D627,432 | S | 11/2010 | Escoto et al. |
| 7,823,806 | B2 | 11/2010 | Schmon |
| D629,623 | S | 12/2010 | Lampe |
| 7,856,940 | B2 | 12/2010 | Wendler |
| 7,913,938 | B2 | 3/2011 | Cooper |
| 7,922,107 | B2 | 4/2011 | Fox |
| D637,269 | S | 5/2011 | Wang |
| D638,121 | S | 5/2011 | Villasana |
| D639,863 | S | 6/2011 | Langan |
| D641,067 | S | 7/2011 | Wang |
| D644,716 | S | 9/2011 | Gehrung |
| D644,803 | S | 9/2011 | Schmon |
| D645,094 | S | 9/2011 | Langan |
| 8,042,402 | B2 | 10/2011 | Brown et al. |
| D649,196 | S | 11/2011 | Langan |
| 8,052,071 | B2 | 11/2011 | Kruse |
| D655,347 | S | 3/2012 | Gehrung |
| 8,127,963 | B2 | 3/2012 | Gerson et al. |
| D657,276 | S | 4/2012 | Brose |
| D661,492 | S | 6/2012 | Ranschau |
| D661,742 | S | 6/2012 | Clark |
| D663,960 | S | 7/2012 | Jeronimo |
| 8,225,892 | B2 | 7/2012 | Ben-Tzvi |
| D664,773 | S | 8/2012 | Papin |
| 8,240,579 | B1 | 8/2012 | Bennett |
| 8,297,536 | B2 | 10/2012 | Ruda |
| D670,085 | S | 11/2012 | Brookman et al. |
| D671,988 | S | 12/2012 | Leipold |
| D672,012 | S | 12/2012 | Brose et al. |
| D674,880 | S | 1/2013 | Schmon |
| 8,352,744 | B2 | 1/2013 | Kruse |
| 8,360,345 | B2 | 1/2013 | Micheli |
| D681,162 | S | 4/2013 | Kruse |
| 8,444,067 | B2 | 5/2013 | Schmon et al. |
| 8,454,759 | B2 | 6/2013 | Selsvik |
| 8,481,124 | B2 | 7/2013 | Nolte et al. |
| D689,590 | S | 9/2013 | Brose |
| D689,593 | S | 9/2013 | Schmon |
| D690,799 | S | 10/2013 | Maier |
| D692,530 | S | 10/2013 | Gehrung |
| D692,532 | S | 10/2013 | Li et al. |
| 8,616,434 | B2 | 12/2013 | Wilen |
| D697,584 | S | 1/2014 | Schmon |
| D698,008 | S | 1/2014 | Schmon et al. |
| 8,626,674 | B2 | 1/2014 | Whitehouse |
| 8,642,131 | B2 | 2/2014 | Nolte et al. |
| D704,300 | S | 5/2014 | Li |
| 8,757,182 | B2 | 6/2014 | Schmon |
| 8,807,460 | B2 | 8/2014 | Charpie et al. |
| 8,857,732 | B2 | 10/2014 | Brose |
| D720,015 | S | 12/2014 | Kruse |
| D720,041 | S | 12/2014 | Robinson |
| 8,899,501 | B2 | 12/2014 | Fox et al. |
| D721,785 | S | 1/2015 | Gehrung |
| 8,925,836 | B2 | 1/2015 | Dettlaff |
| D733,369 | S | 6/2015 | Tschan |
| D733,453 | S | 7/2015 | Tschan |
| D734,428 | S | 7/2015 | Wang |
| D734,429 | S | 7/2015 | Wang |
| D734,571 | S | 7/2015 | Tschan |
| 9,073,068 | B2 | 7/2015 | Krayer et al. |
| D737,126 | S | 8/2015 | Tschan |
| D740,393 | S | 10/2015 | Gehrung |
| D745,636 | S | 12/2015 | Lin |
| D757,216 | S | 5/2016 | Gherung |
| D758,533 | S | 6/2016 | Dettlaff |
| D758,537 | S | 6/2016 | Gehrung |
| D768,820 | S | 10/2016 | Binz |
| D770,593 | S | 11/2016 | Gehrung |
| D792,557 | S | 7/2017 | Wang |
| D794,756 | S | 8/2017 | Wang |
| 9,782,784 | B2 | 10/2017 | Schmon et al. |
| 9,878,336 | B2 | 1/2018 | Gehrung |
| D835,235 | S | 12/2018 | Gehrung et al. |
| 10,189,037 | B2 | 1/2019 | Schmon et al. |
| 2001/0004996 | A1 | 6/2001 | Schmon |
| 2001/0040192 | A1 | 11/2001 | Kaneko et al. |
| 2002/0134861 | A1 | 9/2002 | Petrie et al. |
| 2002/0148501 | A1 | 10/2002 | Shieh |
| 2002/0170978 | A1 | 11/2002 | Mohn |
| 2003/0025000 | A1 | 2/2003 | Schmon et al. |
| 2003/0066218 | A1 | 4/2003 | Schweikert |
| 2003/0121476 | A1 | 7/2003 | McIntyre et al. |
| 2003/0127046 | A1 | 7/2003 | Zehner et al. |
| 2003/0164408 | A1 | 9/2003 | Schmon |
| 2003/0177979 | A1 | 9/2003 | Crum et al. |
| 2003/0189105 | A1 | 10/2003 | Schmon |
| 2003/0209568 | A1 | 11/2003 | Douglas et al. |
| 2003/0213857 | A1 | 11/2003 | Schmon et al. |
| 2003/0218596 | A1 | 11/2003 | Eschler |
| 2003/0230636 | A1 | 12/2003 | Rogers |
| 2004/0046051 | A1 | 3/2004 | Santa Cruz et al. |
| 2004/0050432 | A1 | 3/2004 | Breda |
| 2004/0104194 | A1 | 6/2004 | Dennison |
| 2004/0129738 | A1 | 7/2004 | Stukas |
| 2004/0140373 | A1 | 7/2004 | Joseph et al. |
| 2004/0155063 | A1 | 8/2004 | Hofeldt |
| 2004/0177890 | A1 | 9/2004 | Weinmann |
| 2004/0191406 | A1 | 9/2004 | Crum et al. |
| 2004/0217201 | A1 | 11/2004 | Ruda |
| 2004/0233223 | A1 | 11/2004 | Schkolne et al. |
| 2004/0245208 | A1 | 12/2004 | Dennison |
| 2005/0056613 | A1 | 3/2005 | King |
| 2005/0082249 | A1 | 4/2005 | King |
| 2005/0127201 | A1 | 6/2005 | Matsumoto |
| 2005/0145723 | A1 | 7/2005 | Blette et al. |
| 2005/0145724 | A1 | 7/2005 | Blette et al. |
| 2005/0178854 | A1 | 8/2005 | Dodd |
| 2005/0218246 | A1 | 10/2005 | Chatron et al. |
| 2005/0220943 | A1 | 10/2005 | Abrams et al. |
| 2005/0248148 | A1 | 11/2005 | Schenck et al. |
| 2005/0252993 | A1 | 11/2005 | Rogers |
| 2005/0252994 | A1 | 11/2005 | Rogers |
| 2005/0268949 | A1 | 12/2005 | Rosa |
| 2005/0284963 | A1 | 12/2005 | Reedy |
| 2006/0000927 | A1 | 1/2006 | Ruda |
| 2006/0007123 | A1 | 1/2006 | Wilson et al. |
| 2006/0048803 | A1 | 3/2006 | Jessup et al. |
| 2006/0081060 | A1 | 4/2006 | Forster |
| 2006/0113409 | A1 | 6/2006 | Camilleri et al. |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0131795 | A1 | 6/2007 | Abbate et al. |
| 2007/0158349 | A1 | 7/2007 | Schmon et al. |
| 2007/0205305 | A1 | 9/2007 | Vagedes |
| 2007/0221754 | A1 | 9/2007 | Gehrung |
| 2007/0252378 | A1 | 11/2007 | Chambers |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |

(56) References Cited

U.S. PATENT DOCUMENTS

| | | | |
|---|---|---|---|
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2008/0296410 | A1 | 12/2008 | Carey et al. |
| 2009/0014557 | A1 | 1/2009 | Schmon et al. |
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri et al. |
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0021646 | A1 | 1/2010 | Nolte et al. |
| 2010/0059533 | A1 | 3/2010 | Unger et al. |
| 2010/0084493 | A1 | 4/2010 | Troudt |
| 2010/0108783 | A1 | 5/2010 | Joseph et al. |
| 2010/0126541 | A1 | 5/2010 | Schmon |
| 2010/0206963 | A1 | 8/2010 | Huang |
| 2010/0270390 | A1 | 10/2010 | Reitz |
| 2010/0270400 | A1 | 10/2010 | Evar et al. |
| 2011/0024524 | A1 | 2/2011 | Fox |
| 2011/0121103 | A1 | 5/2011 | Carleton et al. |
| 2011/0125607 | A1 | 5/2011 | Wilen |
| 2011/0127767 | A1 | 6/2011 | Wicks et al. |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2012/0187220 | A1 | 7/2012 | Micheli et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0263686 | A1 | 9/2014 | Hedger |
| 2014/0305962 | A1 | 10/2014 | Tschan |
| 2015/0165463 | A1 | 6/2015 | Gehrung |
| 2015/0231655 | A1 | 8/2015 | Adams et al. |
| 2016/0030960 | A1 | 2/2016 | Gehrung |
| 2018/0050356 | A1 | 2/2018 | Gehrung et al. |
| 2018/0050361 | A1 | 2/2018 | Gehrung et al. |
| 2018/0050362 | A1 | 2/2018 | Gehrung et al. |
| 2018/0133727 | A1 | 5/2018 | Schmon et al. |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| CN | 203508251 | U | 4/2014 |
| CN | 203737474 | U | 7/2014 |
| CN | 204294401 | U | 4/2015 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |
| DE | 3016419 | | 11/1981 |
| DE | 8024829.9 | | 9/1982 |
| DE | 3111571 | A1 | 10/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | G 94 16 015.5 | U1 | 11/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |

(56) References Cited

FOREIGN PATENT DOCUMENTS

| | | | |
|---|---|---|---|
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 20 2010 012 449 | U1 | 12/2010 |
| DE | 202010012449 | | 12/2010 |
| DE | 102009032399 | A1 | 1/2011 |
| DE | 102009053449 | | 2/2011 |
| DE | 102010060086 | | 4/2012 |
| DE | 102011106060 | | 1/2013 |
| DE | 102011118120 | | 5/2013 |
| EM | 002066910-0001 | | 3/2013 |
| EM | 002066910-0002 | | 3/2013 |
| EM | 002066910-0003 | | 3/2013 |
| EM | 002066910-0004 | | 3/2013 |
| EM | 002066910-0005 | | 3/2013 |
| EM | 002066910-0006 | | 3/2013 |
| EM | 002066910-0007 | | 3/2013 |
| EM | 002066910-0008 | | 3/2013 |
| EM | 002066910-0009 | | 3/2013 |
| EM | 002066910-0010 | | 3/2013 |
| EP | 0092392 | | 10/1983 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1997561 | A2 | 12/2008 |
| EP | 2017010 | A2 | 1/2009 |
| EP | 2027931 | | 2/2009 |
| EP | 2092987 | A1 | 8/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 657854 | A | 9/1951 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | 58-119862 | | 5/1983 |
| JP | S5998757 | | 6/1984 |
| JP | S601722 | | 1/1985 |
| JP | H01-87805 | | 6/1989 |
| JP | H02258076 | A | 10/1990 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H08196950 | A | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| JP | 2008018296 | A | 1/2008 |
| JP | 2010-528837 | A | 8/2010 |
| TW | 491092 | | 6/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |

(56) References Cited

FOREIGN PATENT DOCUMENTS

| | | | |
|---|---|---|---|
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |
| WO | 2013/131626 | A1 | 9/2013 |

OTHER PUBLICATIONS

German Search Report for Application No. 10 2016 009 957.7 dated Apr. 21, 2017.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 dated Feb. 25, 2014 with English translation.
Restriction Requirement Office Action dated Aug. 28, 2018 in U.S. Appl. No. 15/679,533.
Restriction Requirement Office Action dated Aug. 28, 2018 in U.S. Appl. No. 15/679,461.
Notice of Allowance dated Sep. 14, 2018 in U.S. Appl. No. 29/618,945.
Notice of Allowance dated Sep. 14, 2018 in U.S. Appl. No. 14/113,649.
German Search Report dated Apr. 21, 2017 for application No. 10 2016 009 957.7.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
May 22, 2018 Final Office Action for U.S. Appl. No. 14/113,649.
Jun. 25, 2018 Response to Office Action for U.S. Appl. No. 14/815,210.
Final Office Action in U.S. Appl. No. 14/113,649 dated Jun. 22, 2017.
Response filed in U.S. Appl. No. 15/143,698 dated Jul. 3, 2017.
Response to Restriction Requirement filed in U.S. Appl. No. 14/815,210 dated Jun. 19, 2017.
Printout from Internet www.ehow.com explaining how to choose a spray gun and stating in item 2 "Nozzle sizes vary between about 1 mm and 2 mm.", printed Sep. 7, 2012 (Exhibit 1023 in IPR 2013-0111).
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012 (Exhibit 1024 in IPR 2013-0111).
Printout from Internet of pages from brochure of Walther Pilot showing nozzle sizes for spray guns ranging from 0.3 mm to 2.5 mm, dated 2007, (Exhibit 1025 in IPR 2013-0111).
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (Exhibit 1026 in IPR 2013-0111).
Printout from Internet of p. 28 from current 3Mtm brochure showing Tip/Nozzle/Air Cap Selection Guide with nozzle sizes from 0.5 mm to 3.0 mm., (Exhibit 1027 in IPR 2013-0111).
Decision by EPO regarding opposition proceedings to revoke patent No. 99926841.0-2425/ 1108476, corresponding to '387 patent, 2012, (Exhibit 1029 in IPR 2013-0111).
SATA News Publication Dan-Am Jul.-Sep. 1996, (Exhibit 1034 in IPR 2013-0111).
SATA News Publication Dan-Am Oct.-Dec. 1996, (Exhibit 1035 in IPR 2013-0111).
SATA News Publication Dan-Am Apr.-Jun. 1998 (Exhibit 1036 in IPR 2013-0111).
Dan-Am SATA Catalog 6 for spray guns 1991 (Exhibit 1037 in IPR 2013-0111).
Dan-Am SATA Catalog 8 for spray guns 1994 (Exhibit 1038 in IPR 2013-0111).
Dan-Am Catalog 6—51pp published 1991, (Exhibit 1042 in IPR 2013-0111).
Japanese Industrial Standards B 9809 English translation, 1992 (Exhibit 1049 in IPR 2013-0111).
Japanese Industrial Standards B 9809 revised Mar. 1, 1991 (Exhibit 1050 in IPR 2013-0111).
SATA News, vol. 21, 2009 (Exhibit 2010 in IPR 2013-0111).
Collision Hub TV Document (image from video clip) printed Oct. 9, 2013 (Exhibit 2011 in IPR 2013-0111).
MyRielsMe.com document from press release printed Oct. 9, 2013 (Exhibit 2012 in IPR 2013-0111).
How to set Air pressure, Utube screenshot printed Oct. 9, 2013 (Exhibit 2013 in IPR 2013-0111).
Ohio EPA Letty to Tony Larimer, response to letter dated Aug. 2006 (Exhibit 2014 in IPR 2013-0111).
Pinahs Ben-Tzvi et al, A conceptual design . . . , Mechatrronics 17 (2007) p. 1-13 (Exhibit 2015 in IPR 2013-0111).
On line ad from Amazon.com printed Oct. 14, 2013 (Exhibit 2017 in IPR 2013-0111).

(56) References Cited

OTHER PUBLICATIONS

Rone et al, MEMS-Baed Microdroplet Generation with Integrated Sensing, COMSOL, 2011 (Exhibit 2018 in IPR 2013-0111).
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
Response to Final Office Action and RCE dated Nov. 29, 2016 in U.S. Appl. No. 14/113,649.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process:" California Steel; retrieved on Feb. 12, 2016 from http://www.californiasteel.com/GetPublicFile.aspx?id=53.
Office Action dated Feb. 19, 2016 for U.S. Appl. No. 14/113,649.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office dated Dec. 3, 2017 for Application No. EP16203544 (with English translation of chart on p. 3).
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Final Office Action dated Dec. 7, 2017 for U.S. Appl. No. 14/815,210.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
International Search Report dated Aug. 31, 2016 for PCT/EP2016/061057 filed May 18, 2016.
Written Opinion for PCT/EP2016/061057 filed May 18, 2016.
Response restriction requirement filed May 23, 2016 for Design U.S. Appl. No. 29/516,082.
International Preliminary Report on Patentability for PCT/EP2015/001728 filed Aug. 25, 2015.
Final Office Action dated Mar. 16, 2017 from U.S. Appl. No. 13/698,417, 9 pages.
Response to Office Action dated Jun. 25, 2018 for U.S. Appl. No. 14/815,210.
Response to Final Office Action dated Aug. 22, 2018 for U.S. Appl. No. 14/113,649.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf> (cited in OA for paint spray gun cleaning device).
Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005> (cited in OA for paint spray gun cleaning device).
Restriction Requirement dated Feb. 6, 2015 for Design U.S. Appl. No. 29/486,232.
Office Action dated Mar. 30, 2015 for U.S. Appl. No. 13/698,417.
Response to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dated Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Filed Nov. 16, 2012 for U.S. Appl. No. 13/698,417.
Filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.

(56) References Cited

OTHER PUBLICATIONS

Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Written Opinion dated Sep. 8, 2016 for International Application No. PCT/EP2016/061057 filed May 18, 2016.
Final Office Action dated Sep. 12, 2018 in U.S. Appl. No. 14/815,210.
European Search Report dated Jan. 24, 2018 for Application No. 17186905.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Notice of Allowance dated Jan. 27, 2016 for Design U.S. Appl. No. 29/510,723.
U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
Response filed Dec. 21, 2015 to Office Action dated Jul. 20, 2015 for U.S. Appl. No. 14/113,649.
International Search Report dated Jul. 14, 2016 for International Application No. PCT/EP2016/000809, filed May 17, 2016.
Written Opinin for International Application No. PCT/EP2016/000809, filed May 17, 2016.
Office Action dated Jun. 30, 2017 for U.S. Appl. No. 14/815,210.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Restriction Requirement dated Mar. 18, 2019, for U.S. Appl. No. 29/596,869.
Office Action dated Mar. 15, 2019, for U.S. Appl. No. 14/815,210.
Office Action dated Jan. 25, 2019 for U.S. Appl. No. 15/379,972.
Response to Office Action dated Apr. 5, 2019 for U.S. Appl. No. 15/679,461 (29 pages).
Response to Office Action dated Apr. 9, 2019 for U.S. Appl. No. 15/679,533 (22 pages).
Office Action, dated Jan. 15, 2019, for U.S. Appl. No. 15/679,533.
Office Action, dated Jan. 15, 2019, for U.S. Appl. No. 15/679,461.

* cited by examiner

AIR CAP ARRANGEMENT AND SPRAY GUN

FIELD OF THE DISCLOSURE

The disclosure relates to a spray gun, in particular, to an air cap arrangement for a spray gun and a spray gun with such an air cap.

BACKGROUND

The spray gun is a tool commonly used in industry, for instance, it may be used to spray paint to surfaces of various articles such as furniture, machines and particularly vehicles, respectively auto bodies. The spray gun can comprise a cup for receiving the paint material and a gun body for spraying the paint material. The paint cup can be arranged on the upper side, on the lower side or laterally of the spray gun. When the paint cup is arranged on the upper side, the spray gun is called gravity fed, when the cup is on the lower side, it's a suction or pressure fed spray gun and when the spray gun has a lateral cup it's called a side cup spray gun. As an alternative to the cup, the spray gun may comprise a hose connected with a pressure tank or a pump which supplies the spray gun with paint under pressure.

A gravity fed spray gun according to the state of the art is shown in FIG. 1 in sectional view. The spray gun 1 comprises a gun body 2, which includes a handle 21 and an upper gun body 22 with spray gun head 23. Wherein, the spray gun head 23 is connected with an air cap 5. The spray gun is supplied with compressed air via an air connection 3. The spray gun 1 has a cup connection 4, to which a paint cup can be connected. The paint cup contains the paint that is to be sprayed with the spray gun. The paint flows from the paint cup through the paint inlet 41 into the paint channel 42. The paint nozzle 26 of the gun body 2 is sealed by the paint needle 10, whereby the paint cannot leave the spray gun. When the trigger 11 is actuated, the air piston head 13, which seals the air supply 9 against the air channels inside the spray gun body, is moved backwards and away from its seat. By that, the compressed air can flow through the inner air channels to the air nozzle 55 of the air cap 5, which is a circular orifice that surrounds the paint nozzle 26. The compressed air is blown out of the air nozzle 55 under pressure.

When the trigger 11 is pressed in excess of a certain point, also the paint needle 10 is moved backwards, leaves its seat in the paint nozzle 26 and the paint nozzle 26 is opened. The paint in the paint channel 42 can flow out of the paint nozzle 26. The compressed air that is blown out of the air nozzle 55 generates a vacuum that sucks the paint out of the paint nozzle 26. Additionally, the paint is pressed out of the nozzle by the following paint. The paint flows in direction of the nozzle because of gravity in the case that the spray gun is gravity fed or because of low=pressure when the spray gun is suction fed or because of pressure when the spray gun is pressure fed or when it's supplied with paint from a paint tank via a hose. When the paint flows out of the paint nozzle 55, the paint is atomized and blown into front direction. Here, a substantially cone shaped round spray is generated.

However, for many paint and finishing works, a flat spray is preferred, because a bigger surface can be painted in a shorter time. Moreover, a more uniform and more efficient coating is possible. Thus, most air caps 5 have two lateral horns 53, particularly on the air nozzle, which protrude in direction of the paint spray. These two horns 53 are also supplied with compressed air. The compressed air is set free through one or more horn air nozzles 531 in each horn. In most cases, the nozzles 531 are circular cylindrical bores, but they can also have another shape. Many spray guns have two horn nozzles with different diameters in each horn. The horn air is directed to the paint spray and deforms it from both sides. By that, the paint spray becomes flat. Its cross section becomes smaller in the direction from that the horn air is exposed and bigger in the other both directions, thus a flat spray is formed. The air cap 5 is rotatable around the spray axis. By that, the angle of the flat spray in relation to the spray guns can be changed. In most cases, a vertical spray is desired.

FIG. 2 and FIG. 3 respective show a sectional view of the air cap arrangement and the spray gun head according to the state of the art above. Wherein, the content shown in FIG. 3 is the same as that shown in FIG. 1, but in FIG. 2, the paint nozzle 26, the paint needle 10 and a sealing in the paint inlet 41 are omitted for easier explanation.

The spray gun head consists of a spray gun body head 23 and an air cap arrangement composed of the air cap 5, a cap ring 6 and a retaining ring 7. The air cap 5 comprises two air horns 53 each having one air horn nozzle 531. The air cap ring 6 surrounds the circumferential outside surface of the air cap 5, and is connected with the gun body 2. A step 51 is arranged on the circumferential outside surface of the air cap 5 in which the outer diameter of the step 51 is larger than the outer diameter of the circumferential outside surface of the air cap 5 such that the step 51 protrudes in the radial direction and acts as a stopper for the air cap 5. A protrusion 61 is arranged on the circumferential inner surface of the air cap ring 6 and contacts against a surface of the step 51 towards the front, to prevent the air cap 5 from moving forward with respect to the air cap ring 6. And a groove 52 is also arranged on the circumferential outside surface of the air cap 5, thus through setting the retaining ring 7 in to the groove 52, the situation that the air cap 5 slips backwards and out of the air cap ring 6 can be avoided. Therefore, the step 51 of the air cap 5, the protrusion 61 of the air cap ring 6 and the retaining ring 7 ensure the connection of the air cap 5 and the spray gun head 23, and the air cap 5 is not or hardly moveable along the spray axis. The step 51, the groove 52 and the protrusion 61 are advantageously run over the whole circumference of the air cap 5 or the air cap ring 6 respectively; the retaining ring 7 is advantageously cut at one position.

However, there are still some problems in such connection manner of the air cap 5 and the spray gun head 23:

1) Since the retaining ring 7 is provided out of the cap ring 6, foreign matter such as the paint may be attached on the retaining ring 7 or near the retaining ring 7 such that it is difficult to keep the spray gun clean.

2) It is very difficult and hard for the user to remove the air cap 5 from the air cap arrangement, particularly from the air cap ring 6 for cleaning and maintenance, because the retaining ring 7 is sitting in the groove 52 of the air cap 5 very tightly and at least one tool is required for that purpose to pull or push the retaining ring 7 out of the groove 52.

3) As the retaining ring 7 is lying at the air cap 5 in front of the air cap ring 6, the air cap 5 has to be relatively long, i.e. it has to protrude out from the air cap ring 6 relatively far. By that, much material is required for manufacturing the air cap 5 and the air cap 5 becomes heavier.

4) Since the retaining ring 7 is provided out of the cap ring 1, the gun is not aesthetically pleasing.

Furthermore, as shown in FIG. 3, a circular protrusion 54, which surrounds the spray axis, is arranged on the rear surface of the air cap 5, and the outside surface of end of the circular protrusion 54 is formed as a circular cone shape 541.

Furthermore, a circular protrusion 27 is also arranged on the paint nozzle 26, and the inner surface of the end of the protrusion 27 is also configured as circular cone 271. The air cap 5 can be aligned with respect to the paint nozzle 26 through making the circular cone 541 of the circular protrusion 54 to contact against the circular cone 271 of the circular protrusion 27. However, the connection manner of the air cap 5 and the spray gun head 23 limits the movement of the air cap 5, and impedes the air cap 5 from aligning with the paint nozzle 26.

SUMMARY OF THE DISCLOSURE

The disclosure relates to an air cap arrangement and a spray gun that addresses at least some of the issues identified above.

According to one aspect of the disclosure, an air cap arrangement for spray gun comprises an air cap, an air cap ring and a retaining ring, in which the air cap has a circumferential outer surface extending longitudinally, and the air cap ring has a circumferential inner surface extending longitudinally. The air cap ring comprises a groove configured to extend on the circumferential inner surface of the air cap ring; the air cap also comprises a groove configured to extend on the circumferential outer surface of the air cap, and the retaining ring is arranged in the groove of the air cap ring and the groove of the air cap to limit the axial movement of the air cap within the air cap ring.

In some embodiments, the air cap ring further comprises a protrusion configured to protrude radially from the circumferential inner surface of the air cap ring, and the groove of the air cap ring is further configured to extend circumferentially and locate closer to the front end of the air cap ring than the protrusion. The air cap can further comprise a step configured to protrude radially from the circumferential outer surface of the air cap, and the groove of the air cap is configured to extend circumferentially and locate closer to the front end of the air cap than the step. And the front surface of the step can contact against the rear surface of the protrusion.

In an embodiment, the inner surface of the rear end of the air cap ring is provided with a thread.

In an embodiment, the retaining ring is flexible.

In an embodiment, the retaining ring is a polygonal ring.

In an embodiment, the retaining ring is made of elastic material.

In an embodiment, the retaining ring is made of rubber material.

In an embodiment, the rear end of the air cap is provided with a circular protrusion protruding backward, and the end, protruding backward, of the circular protrusion is provided with a circular cone surface.

In an embodiment, the step and the protrusion run over the whole circumference respectively.

In an embodiment, at least one of the step and the protrusion is discontinuous.

In an embodiment, the retaining ring is an entire ring.

In an embodiment, the retaining ring comprises a cut.

According to another aspect of the disclosure a spray gun comprises a gun body and an air cap arrangement, wherein the spray gun head of the gun body is connected with the air cap arrangement, the air cap arrangement comprises an air cap, an air cap ring and a retaining ring, in which a rear rend of the air cap ring is connected with the spray gun head, the air cap has a circumferential outer surface extending longitudinally, and the air cap ring has a circumferential inner surface extending longitudinally. The air cap ring comprises a groove configured to extend on the circumferential inner surface of the air cap ring; the air cap also comprises a groove configured to extend on the circumferential outer surface of the air cap. And the retaining ring is arranged in the groove of the air cap ring and the groove of the air cap to limit the axial movement of the air cap within the air cap ring.

In some embodiments, the air cap ring further comprises a protrusion configured to protrude radially from the circumferential inner surface of the air cap ring, and the groove of air cap ring is further configured to extend circumferentially and locate closer to the front end of the air cap ring than the protrusion. The air cap can further comprise a step configured to protrude radially from the circumferential outer surface of the air cap, and the groove of the air cap is further configured to extend circumferentially and locate closer to the front end of the air cap than the step. And the front surface of the step can contact against the rear surface of the protrusion.

In an embodiment, the inner surface of the rear end of the air cap ring is provided with a thread to be connected with the external thread of the spray gun.

In an embodiment, the retaining ring is flexible.

In an embodiment, the retaining ring is a polygonal ring.

In an embodiment, the retaining ring is made of elastic material.

In an embodiment, the retaining ring is made of rubber material.

In an embodiment, the rear end of the air cap is provided with a first circular protrusion protruding backward, and the end, protruding backward, of the circular protrusion is provided with a circular cone surface. A paint nozzle arranged in the spray gun is provided with a second circular protrusion protruding forward, and the end, protruding forward, of the second circular protrusion is provided with a circular cone surface, contacting against the circular cone surface of the first circular protrusion.

In an embodiment, the step and the protrusion run over the whole circumference respectively.

In an embodiment, at least one of the step and the protrusion is discontinuous.

In an embodiment, the retaining ring is an entire ring.

In an embodiment, the retaining ring comprises a cut.

Through the structure of the air cap arrangement of present disclosure, it is easy to remove the air cap from the air cap ring for cleaning; the air cap can readily rotate with the air cap ring to adjust the orientation of the spray flat; the air flow is more stable because it is not disturbed by the retaining ring; and the air cap can be aligned with the paint nozzle. Therefore the air cap arrangement and the spray gun of present disclosure involves advantageous technical effect while overcoming the problem in the prior art.

BRIEF DESCRIPTION OF THE DRAWINGS

The drawings constitute a portion of the description for further understanding of the present disclosure. These drawings illustrate the embodiments of the present disclosure and explain the principle of the present disclosure together with the description. In the drawings, the same part is represented by the same reference sign. In the drawings.

DETAILED DESCRIPTION

The front direction mentioned herein refers to a direction pointed by the spray gun head, and the rear direction refers to a direction substantially opposite to the front direction; and the up direction mentioned in the present application refers to a direction substantially opposite to the handle direction in a normal hand-held operation state when the handle points downwards. The left side or right side mentioned herein refers to a side of the spray gun or spray gun body corresponding to the operator's left hand or right hand, viewing from the operator's angle, in the normal hand-held operation state when the spray gun head points to the front and the handle points downwards.

Example 1

Figure 1:
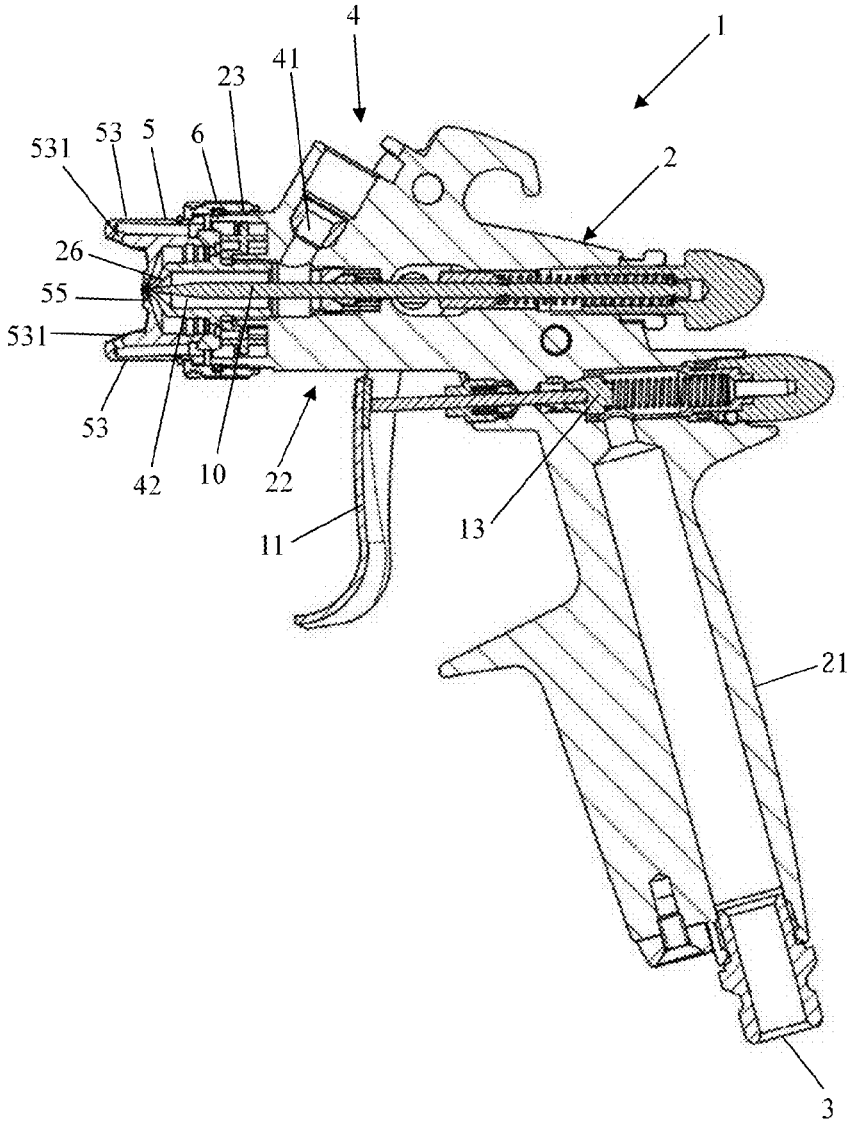
Fig. 1 (Prior Art)
FIG. 1 is a schematic diagram illustrating a spray gun according to the prior art.
Figure 2:
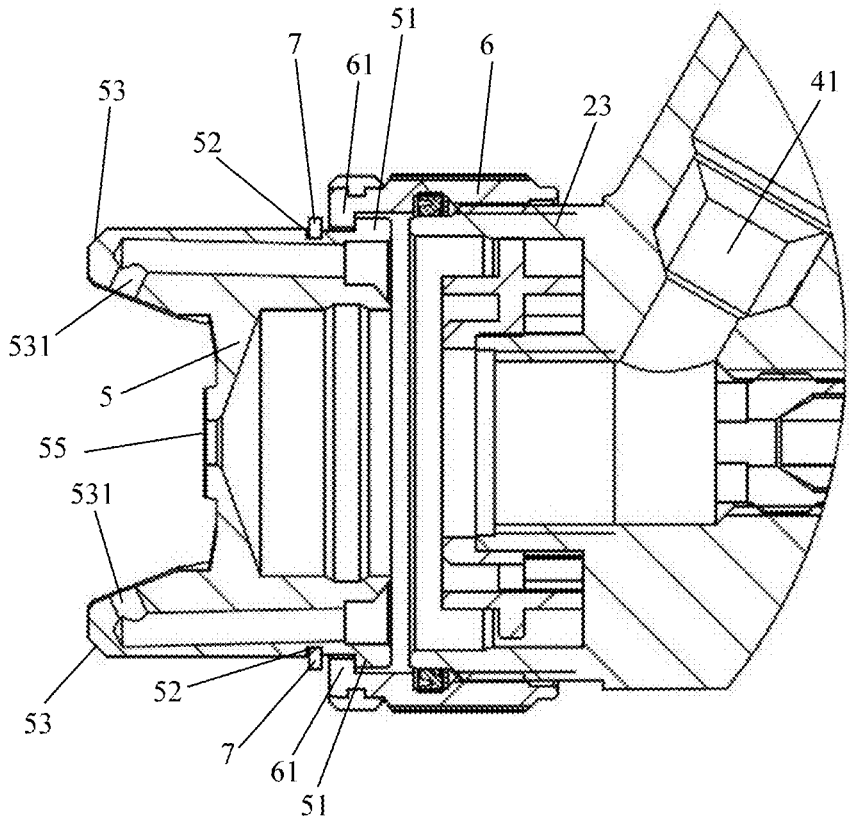
Fig. 2 (Prior Art)
FIG. 2 is an enlarged schematic diagram illustrating a sectional view of the air cap arrangement and the spray gun head according to the prior art.
Figure 3:
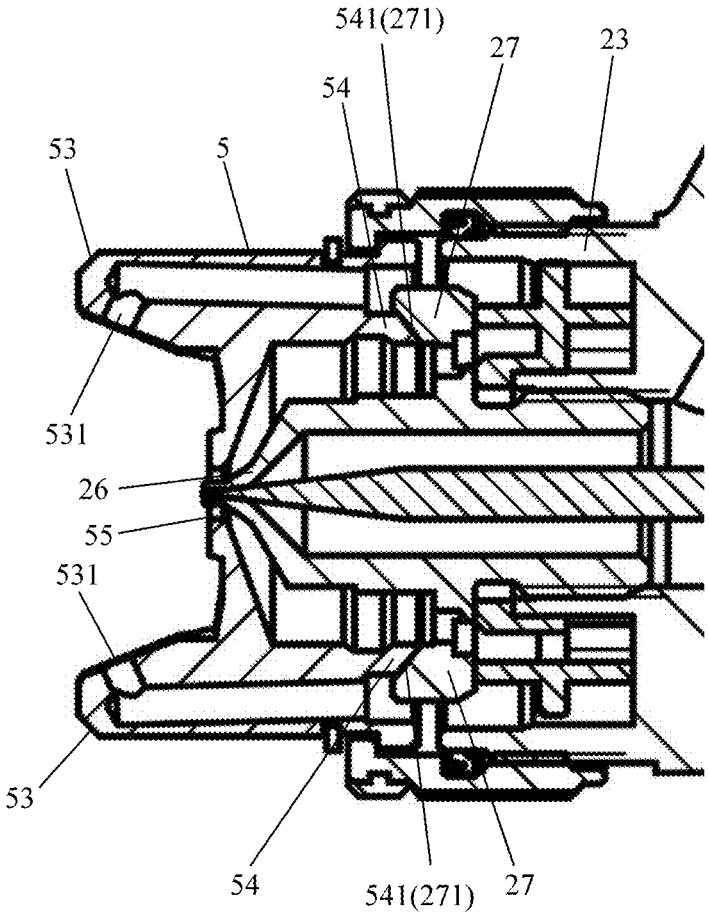
Fig. 3 (Prior Art)
FIG. 3 is an enlarged schematic diagram illustrating a sectional view of the air cap arrangement and the spray gun head according to the prior art.
Figure 4:
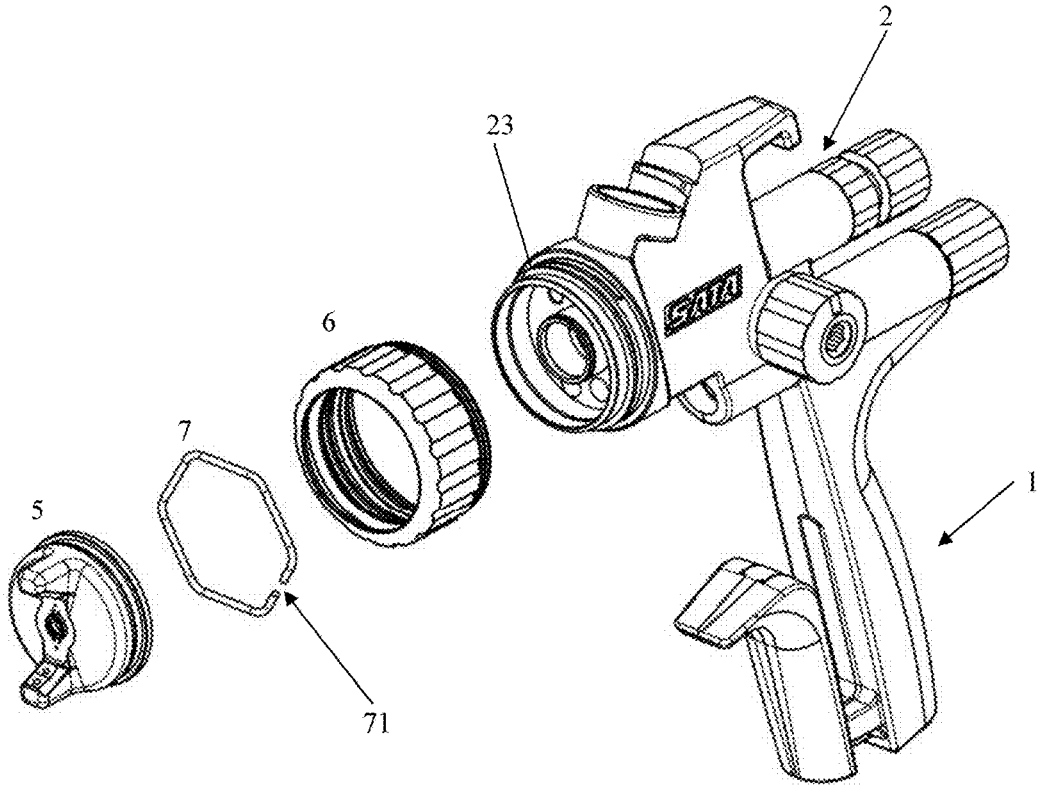
FIG. 4 is a disassembling diagram illustrating an air cap arrangement according to Example 1 of present disclosure.

FIG. 4 is a disassembling diagram illustrating an air cap arrangement according to Example 1 of present disclosure. As shown in FIG. 4, the air cap arrangement proposed by Example 1 of present disclosure comprises an air cap 5, an air cap ring 6 and a retaining ring 7 having a cut 71 in this embodiment. The air cap ring 6 is connected with the spray gun head 23 on the gun body 2 of the spray gun 1.

Figure 5A:
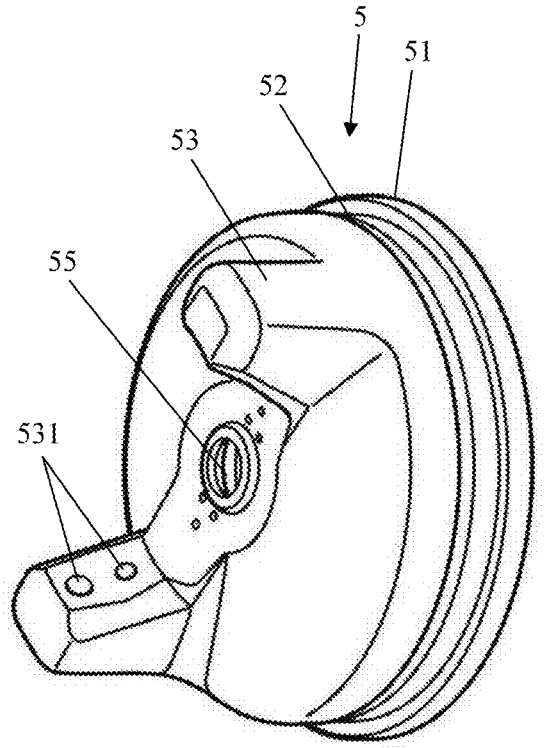
FIG. 5A is a schematic diagram illustrating the air cap according to Example 1 of present disclosure.

FIG. 5A is a schematic diagram illustrating the air cap according to Example 1 of present disclosure. As shown in FIG. 5A, the front end of the air cap 5 has two two lateral horns 53, and each of the lateral horns 53 comprises horn air nozzle(s) 531. The air cap 5 comprises: a step 51 configured to protrude radially from the circumferential outer surface of the air cap 5; and a groove 52 configured to extend circumferentially on the circumferential outer surface of the air cap 5 and locate closer to the front end of the air cap 5 than the step 51.

Figure 5B:
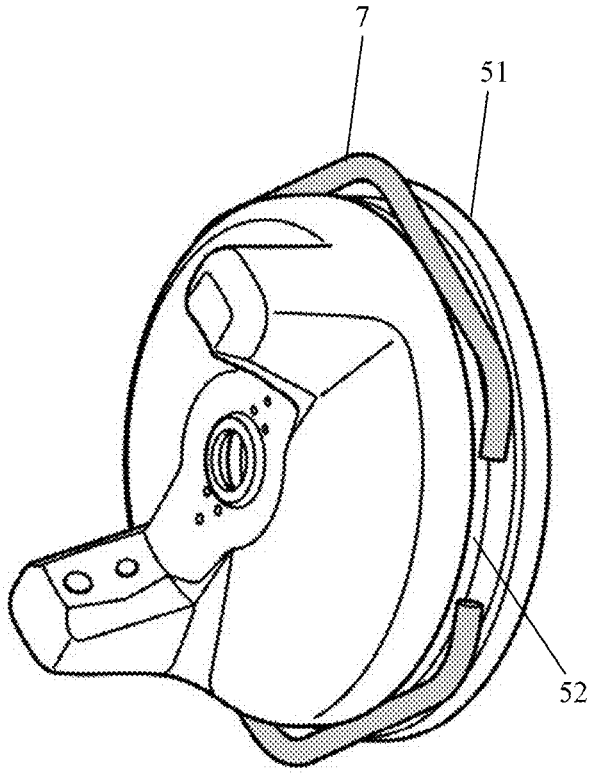
FIG. 5B is a schematic diagram illustrating the air cap with the retaining ring according to Example 1 of present disclosure.

FIG. 5B is a schematic diagram illustrating the air cap with the retaining ring according to Example 1 of present disclosure. As shown in FIG. 5B, the retaining ring 7 can be arranged in the groove 52 of the air cap 5. And since the retaining ring 7 is polygonal, the contact area between the retaining ring 7 and the groove 52 is small, thus the friction between them is small.

Figure 6A:
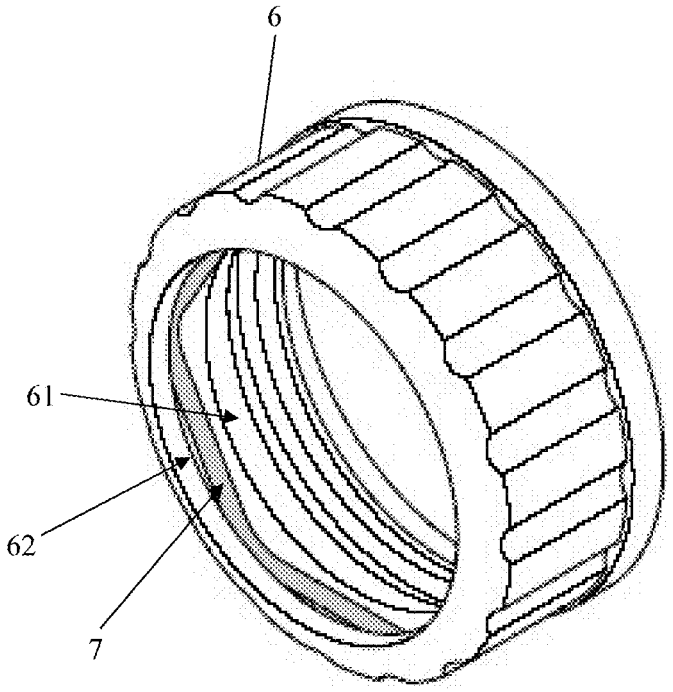
FIG. 6A is a schematic diagram illustrating a front view of the air cap ring with the retaining ring according to Example 1 of present disclosure.
Figure 6B:
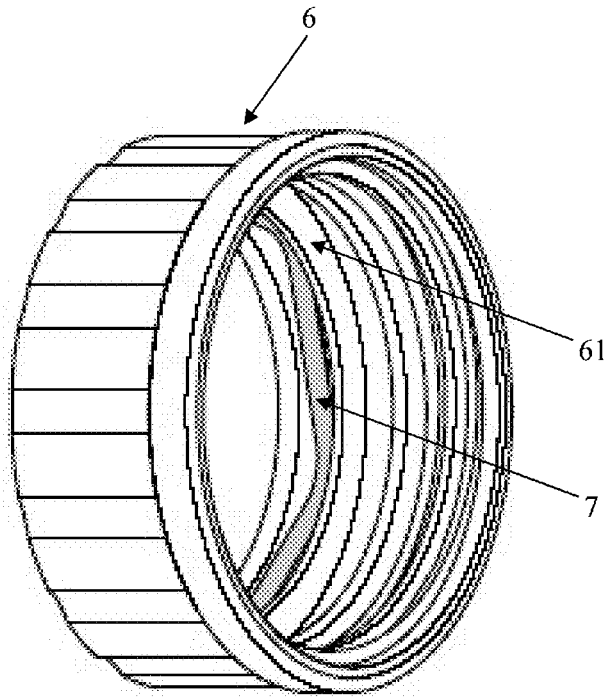
FIG. 6B is a schematic diagram illustrating a rear view of the air cap ring with the retaining ring according to Example 1 of present disclosure.

FIG. 6A and FIG. 6B respectively illustrates the front view and rear view of the air cap ring with the retaining ring according to Example 1 of present disclosure. And as shown in FIGS. 6A and 6B, a protrusion 61 is still arranged on the circumferential inner surface of the air cap ring 6. However, the protrusion 61 is located closer to the rear end of the air cap ring 6 than that of the prior art. Furthermore, a groove 62 is arranged on the circumferential inner surface of the air cap ring 6 and closer to the front end of the air cap ring 6 with respect to the protrusion 61. And furthermore, the retaining ring 7 can be arranged in the groove 62 of the air cap ring 6.

As shown in FIGS. 6A and 6B, since the retaining ring 7 is polygonal, the contact area between the retaining ring 7 and the groove 62 is small, thus the friction between them is small.

It should be noted that in FIGS. 5B and 6B, both the air cap 5 as well as the air cap ring 6 are equipped with a retaining ring 7, only to show the position of the retaining ring 7 in the groove 52 and the groove 62 when the air cap 5 and the air cap arrangement is assembled, i.e. when the air cap 5 and the air cap ring 6 are connected. However, the assembled air cap arrangement preferably comprises just one single retaining ring 7. However, of course it can also comprise several retaining rings arranged in several grooves.

Figure 7:
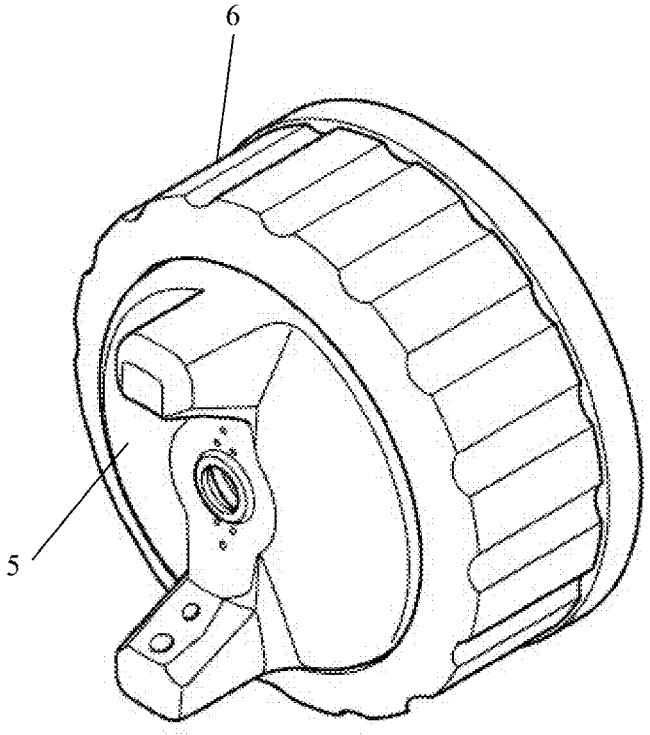
FIG. 7 is a schematic diagram illustrating an assembled air cap arrangement according to Example 1 of present disclosure.

The air cap 5 can be inserted from the rear end of the air cap ring 6 arranged with the retaining ring 7, to form the air cap arrangement, as shown in FIG. 7. As an alternative to this preferred solution, it can be provided that the air cap 5 can be equipped with the retaining ring 7 before inserting it from the from the rear end of the air cap ring 6.

Figure 8:
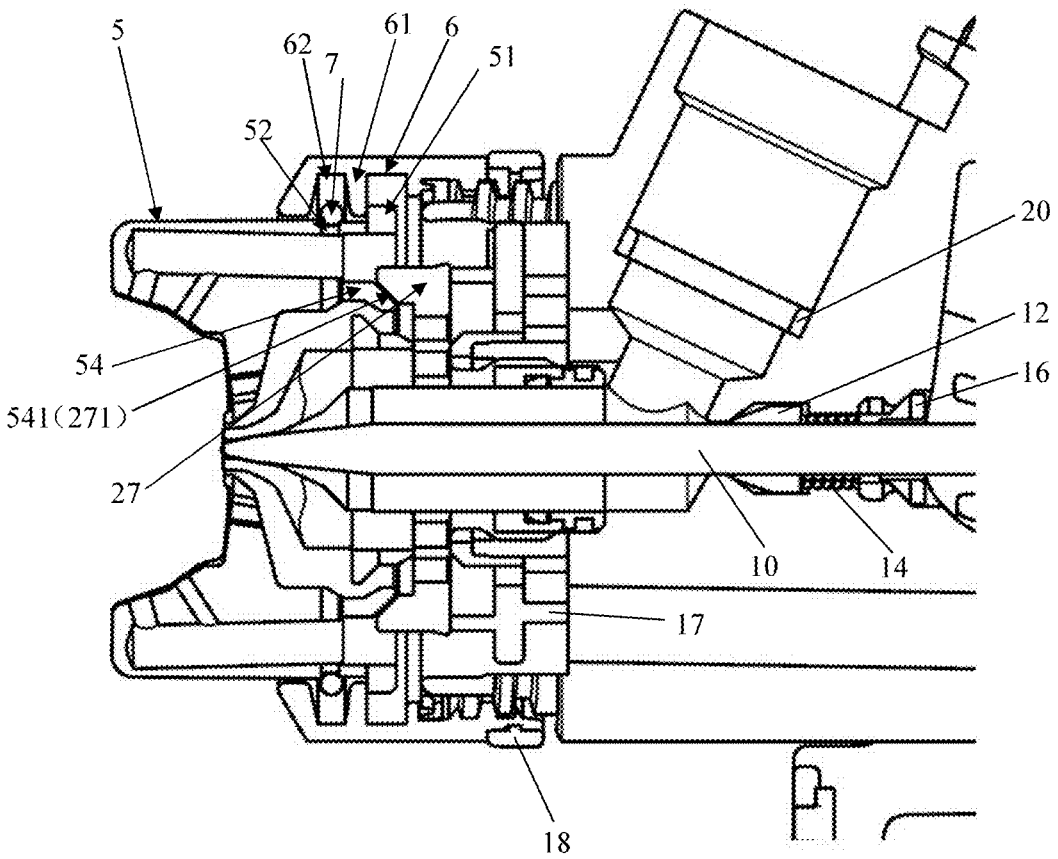
FIG. 8 is a schematic diagram illustrating a sectional view of the air cap arrangement and the spray gun head according to Example 1 of present disclosure.

FIG. 8 is a schematic diagram illustrating a sectional view of the air cap arrangement and the spray gun head according to Example 1 of present disclosure. As shown in FIG. 8, the front surface of the step 51 can contact against the rear surface of the protrusion 61 of the air cap ring 6 to prevent the air cap 5 from moving forward with respect to the air cap ring 6.

Furthermore, since the groove 52 is located in front of the step 51, when the air cap 5 is inserted into the air cap ring 6 from the rear of the air cap ring 6, the retaining ring 7 disposed in the groove 62 will enter the groove 52 of the air cap 5. Thus the retaining ring 7 can prevent the air cap 5 from moving backward with respect to the air cap ring 6.

Thus, in the air cap ring arrangement above, the air cap 5 can rotate in the air cap ring 6 around the spray axis, and the air cap 5 is not or hardly moveable in the direction of spray axis.

The step 51, the groove 52 and the protrusion 61 advantageously run over the whole circumference of the air cap 5 or the air cap ring 6 respectively; the retaining ring 7 is advantageously cut 71 at one position, As shown in FIGS. 4 and 5B.

Since the retaining ring 7 is flexible to some extent, the air cap 5 can be pressed out only by pressing the air cap 5 toward the rear end of the air cap ring 6 when the user wants to remove the air cap 5 from the air cap ring 6. Therefore, compared to prior art, it is easy to remove the air cap 5 from the air cap ring 6 and clean it.

As shown in FIGS. 4 and 5B, since the retaining ring 7 comprises a cut 71, the retaining ring 7 may be more flexible to make it easier to remove air cap 5 from the air cap ring 6.

Furthermore, since the retaining ring 7 is arranged in the air cap ring 6 rather than exposed to outside, therefore the foreign matter is prevented from attaching on or near the retaining ring 7 such that the spray gun is kept clean.

Furthermore, as shown in the FIG. 8, retaining ring 7 is arranged in the air cap ring 6, thus it is unnecessary to protrude the air cap 5 out of the air cap ring 6 too far, thus the length of the air cap 5 is reduced such that the weight of the air cap 5 is reduced and the material is saved. And since the retaining ring 7 is arranged in the air cap ring 6, the spray gun is aesthetically pleasing.

Furthermore, as shown in FIGS. 4 and 5B, the retaining ring 7 is a hexagonal ring, thus the contact area between the retaining ring 7 and the groove 62 of the air cap ring 6 is small, and the contact area between the retaining ring 7 and the groove 52 of the air cap 5 is also small. Thus, the friction between the retaining ring 7 and the air cap ring 6 and the friction between the retaining ring 7 and the air cap 5 are both small, so that the air cap 5 can readily rotate with respect to the air cap ring 6 to adjust the orientation of the spray flat. At the same time, as it is already the case with spray guns according to the state of the art, the air cap 5 is fixed when the air cap ring 6 is screwed tight to the spray gun head 23, so that the orientation of the flat spray is fix and cannot be changed unintentionally.

Furthermore, as shown in FIG. 8, since the retaining ring 7 is arranged in the groove 52 disposed on the circumferential outside surface of the air cap 5, thus the retaining ring 7 doesn't lie within the air path. Thus, the flow of the air is not disturbed so that the flow of the air can be kept stable.

Furthermore, as shown in FIG. 8, a circular protrusion 54, which surrounds the spray axis, is arranged on the rear surface of the air cap 5, and the outside surface of end of the circular protrusion 54 is formed as a circular cone surface 541. A circular protrusion 27 is also arranged on the paint nozzle 26, and the inner surface of the end of the protrusion 27 is also configured as circular cone surface 271. The air cap 5 can be aligned with respect to the paint nozzle 26 through making the circular cone surface 541 of the circular protrusion 54 to contact against the circuit cone surface 271 of the circular protrusion 27. In the state of the art, the connection manner of the air cap 5 and the spray gun head 23 limits the movement of the air cap 5, and impedes the air cap 5 from aligning with the paint nozzle 26. However, with the present disclosure, since the retaining ring 7 is not lying tightly in the groove 62, but has space (As shown in FIG. 8), it doesn't impede the air cap 5 from aligning with the paint nozzle 26.

The spray gun according to the present disclosure and a spray gun having an air cap arrangement according to the present disclosure may further have a paint needle 10, a needle sealing arrangement comprising a sealing element 12, a pressure spring 14 and a fixing element 16. The sealing arrangement seals the paint conducting channel in the spray gun body against the outer areas. The paint needle 10 is sliding within the axial symmetrical sealing element 12 when the spray gun is activated, i.e. when the trigger is pulled, by which the sealing element wears out. However, due to the pressure spring 14, which lies against the fixing element 16 and presses against the sealing element 12, the sealing element 12 always lies in its seat tightly. The spray gun can further comprise an air distribution ring 17, a colored marking ring 18, a sealing element 20 in the paint cup connection, a hook, a pressure measuring device and other components known in the state of the art.

Accordingly, through the structure of the air cap arrangement of present Example 1, it is easy to remove the air cap 5 from the air cap ring 6 for cleaning; the air cap 5 can readily rotate with the air cap ring 6 to adjust the orientation of the spray flat; the air flow is more stable because it is not disturbed by the retaining ring 7; and the air cap 5 can be aligned with the paint nozzle 26 more precisely. Therefore, the air cap arrangement of Example 1 involves advantageous technical effect while overcoming the problem in the prior art.

However, the example described above is only used to explain the disclosure, but should not be viewed as the limitation to the disclosure. For example, although the retaining ring 7 used in the Example 1 is hexagon, the retaining ring 7 can also be any other polygonal ring with different number of edges, such as pentagon and heptagon. Furthermore, although the retaining ring 7 in the above Example 1 comprises a cut at the position 71, the retaining ring 7 can also be an entire ring. Although the step 51 and the protrusion 61 in the Example 1 run over the whole circumference of the air cap 5 or the air cap ring 6, the step 51 and/or the protrusion 61 can be discontinuous, as long as they may prevent the air cap 5 from moving forward.

Example 2

Figure 9A:
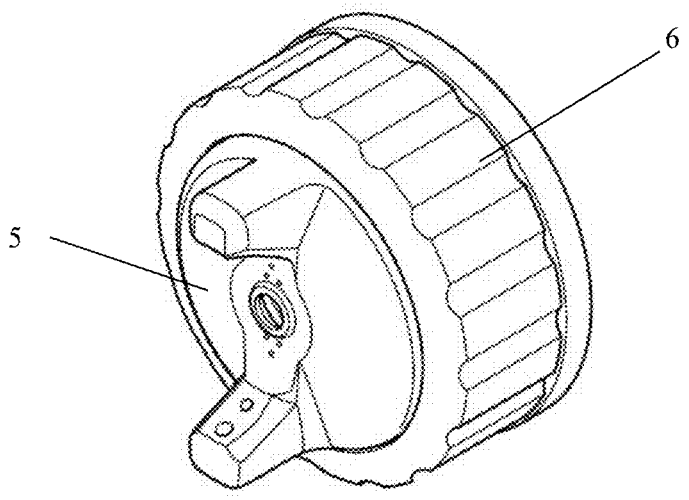
FIG. 9A is a schematic diagram illustrating the air cap arrangement according to Example 2 of present disclosure.

FIG. 9A is a schematic diagram illustrating the air cap arrangement according to Example 2 of present disclosure. And FIG. 9B illustrates a schematic diagram of an air cap 5 and retaining ring 7' according to Example 2 of present disclosure.

Figure 9B:
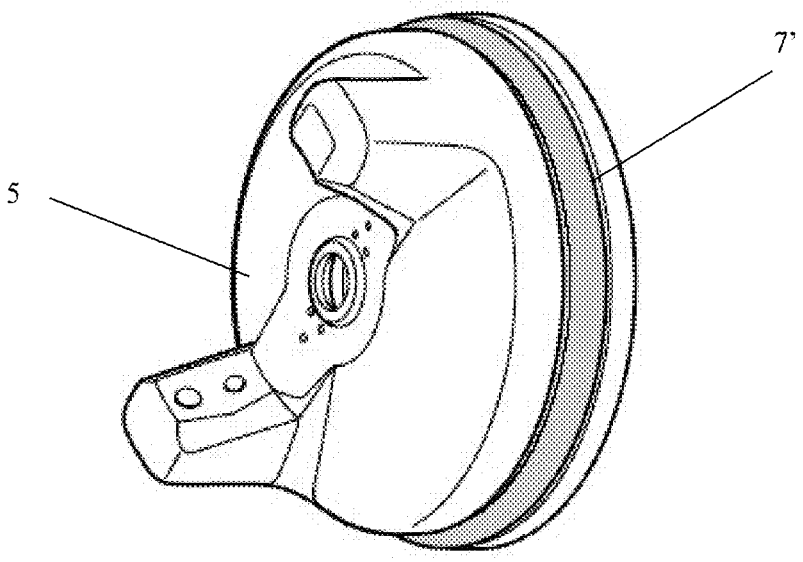
FIG. 9B is a schematic diagram illustrating the air cap with the retaining ring according to Example 2 of present disclosure.

As shown in FIGS. 9A and 9B, the air cap arrangement described in Example 2 is substantively similar to that of Example 1, and the difference only lies in the retaining ring 7' used in Example 2 and the ring 7 described in Example 1.

As shown in FIG. 9B, the retaining ring 7' used in Example 2 is a elastic holding ring made of rubber or other elastic material. Similar technical effect as that of Example 1 can be achieved through arranging the retaining ring 7' in the grooves of the air cap ring 6 and the air cap 5 (not shown). In this Example, it is preferred to first arrange the retaining ring 7' into the groove 52 of the air cap 5 and then insert the air cap 5 from the rear end of the air cap ring 6 into the air cap ring 6 to form the air cap arrangement. However, it can of course also be provided to first arrange the retaining ring 7' into the groove 62 of the air cap ring 6 and then insert the air cap 5.

And preferably, the retaining ring 7' is an entire circular ring. However, as for present disclosure, the retaining ring 7' can be cut to increase its flexibility. Furthermore, the retaining ring 7' can also be configured as a polygonal ring as described in Example 1.

What is claimed is:

1. An air cap arrangement for a spray gun, said air cap arrangement comprising:

an air cap;

an air cap ring; and a retaining ring, wherein the air cap has a circumferential outer surface extending longitudinally, and the air cap ring has a circumferential inner surface extending longitudinally, the air cap ring comprises a groove configured to extend on the circumferential inner surface of the air cap ring, the air cap comprises a groove configured to extend on the circumferential outer surface of the air cap, the retaining ring is arranged in the groove of the air cap ring and the groove of the air cap to limit the axial movement of the air cap within the air cap ring, the air cap ring further comprises a protrusion configured to protrude radially from the circumferential inner surface of the air cap ring, the groove of the air cap ring is further configured to extend circumferentially and to be located closer to a front end of the air cap ring than the protrusion, the air cap further comprises a step configured to protrude radially from the circumferential outer surface of the air cap, the groove of the air cap is further configured to extend circumferentially and to be located closer to a front end of the air cap than the step, and a front face of the step, which faces the front end of the air cap, is configured to contact against a rear face of the protrusion, which faces a rear end of the air cap ring, when the air cap arrangement is assembled.

2. The air cap arrangement according to claim 1, wherein the circumferential inner surface of the rear end of the air cap ring is provided with a thread.

3. The air cap arrangement according to claim 1, wherein the retaining ring is configured to be flexible such that the air cap can be pressed out of the air cap ring by only pressing the air cap toward the rear end of the air cap ring.

4. The air cap arrangement according to claim 3, wherein the retaining ring is a polygonal ring.

5. The air cap arrangement according to claim 3, wherein the retaining ring is made of elastic material.

6. The air cap arrangement according to claim 3, wherein the retaining ring is made of rubber material.

7. The air cap arrangement according to claim 1, wherein the rear end of the air cap is provided with a circular protrusion protruding backward, and an end, protruding backward, of the circular protrusion is provided with a circular cone surface.

8. The air cap arrangement according to claim 1, wherein the step and the protrusion each run over the whole circumference.

9. The air cap arrangement according to claim 1, wherein at least one of the step and the protrusion is discontinuous.

10. The air cap arrangement according to claim 1, wherein the retaining ring is an entire ring.

11. The air cap arrangement according to claim 1, wherein the retaining ring comprises a cut.

12. The air cap arrangement according to claim 1, wherein the front face of the step and the rear face of the protrusion each extend in a radial direction of the air cap arrangement.

13. The air cap arrangement according to claim 1, wherein the groove of the air cap is configured to be separated from the step of the air cap in an axial direction of the air cap arrangement.

14. The air cap arrangement according to claim 13, wherein the protrusion of the air cap ring is configured to be located entirely between the groove of the air cap and the step of the air cap in the axial direction when the air cap arrangement is assembled.

15. The air cap arrangement according to claim 1, wherein the step of the air cap is configured to protrude radially further than the circumferential outer surface of the air cap at a front side of the groove of the air cap.

16. A spray gun comprising:

a gun body that includes a spray gun head; and an air cap arrangement, the spray gun head of the gun body being connected with the air cap arrangement, wherein the air cap arrangement comprises an air cap, an air cap ring, and a retaining ring, a rear end of the air cap ring is connected with the spray gun head, the air cap has a circumferential outer surface extending longitudinally, and the air cap ring has a circumferential inner surface extending longitudinally, the air cap ring comprises a groove configured to extend on the circumferential inner surface of the air cap ring, the air cap comprises a groove configured to extend on the circumferential outer surface of the air cap, and the retaining ring is arranged in the groove of the air cap ring and the groove of the air cap to limit the axial movement of the air cap within the air cap ring, the air cap ring further comprises a protrusion configured to protrude radially from the circumferential inner surface of the air cap ring, the groove of the air cap ring is further configured to extend circumferentially and to be located closer to a front end of the air cap ring than the protrusion, the air cap further comprises a step configured to protrude radially from the circumferential outer surface of the air cap, the groove of the air cap is further configured to extend circumferentially and to be located closer to a front end of the air cap than the step, and a front face of the step, which faces the front end of the air cap, is configured to contact against a rear face of the protrusion, which faces a rear end of the air cap ring, when the air cap arrangement is assembled.

17. The spray gun according to claim 16, wherein the rear end of the air cap is provided with a first circular protrusion protruding backward, and an end, protruding backward, of the first circular protrusion is configured in a circular cone surface, the spray gun further comprises a paint nozzle that is provided with a second circular protrusion protruding forward, and an end, protruding forward, of the second circular protrusion is configured in a circular cone surface, and the circular cone surface of the second circular protrusion is configured to contact against the circular cone surface of the first circular protrusion when the air cap arrangement is assembled.

18. The spray gun according to claim 16, wherein the air cap, the air cap ring, and the retaining ring are configured such that the air cap can readily rotate with respect to the air cap ring around a spray axis to adjust spray orientation when the air cap arrangement is assembled.

* * * * *